US008485111B2

(12) United States Patent
Chinuki et al.

(10) Patent No.: US 8,485,111 B2
(45) Date of Patent: Jul. 16, 2013

(54) TABLE AND TABLE SYSTEM

(75) Inventors: Motonari Chinuki, Inzai (JP); Motoki Koyanagi, Tokyo (JP); Maiko Kawarai, Tokyo (JP)

(73) Assignee: The Bank of Tokyo-Mitsubishi UFJ, Ltd., Tokyo (JP)

( * ) Notice: Subject to any disclaimer, the term of this patent is extended or adjusted under 35 U.S.C. 154(b) by 0 days.

(21) Appl. No.: 13/308,870

(22) Filed: Dec. 1, 2011

(65) Prior Publication Data

US 2012/0137936 A1 Jun. 7, 2012

(30) Foreign Application Priority Data

Dec. 3, 2010 (JP) ..... 2010-270740

(51) Int. Cl.
*A47B 37/00* (2006.01)

(52) U.S. Cl.
USPC ..... 108/50.01; 108/50.02

(58) Field of Classification Search
USPC ..... 108/50.01, 50.02, 150, 64; 312/223.6, 312/223.2
See application file for complete search history.

(56) References Cited

U.S. PATENT DOCUMENTS

| | | | | | |
|---|---|---|---|---|---|
| 3,724,798 | A * | 4/1973 | Lucasey | 108/50.01 |
| 4,365,561 | A * | 12/1982 | Tellier et al. | 108/64 |
| 4,852,500 | A * | 8/1989 | Ryburg et al. | 108/50.01 |
| 5,485,795 | A * | 1/1996 | Williams | 108/64 |
| 5,673,631 | A * | 10/1997 | Guns et al. | 108/64 |
| 5,842,425 | A * | 12/1998 | van der Aa | 108/64 |
| 5,868,079 | A * | 2/1999 | Charny | 108/50.01 |
| 5,943,966 | A * | 8/1999 | Machado et al. | 108/64 |
| 6,161,487 | A * | 12/2000 | Chang | 108/50.01 |
| 6,298,794 | B1 * | 10/2001 | Brown et al. | 108/50.01 |
| 6,390,432 | B1 * | 5/2002 | VanderHeide et al. | 108/50.01 |
| 6,722,673 | B1 * | 4/2004 | Hamlin | 108/50.01 |
| 7,357,086 | B2 * | 4/2008 | Petrick et al. | 108/50.02 |
| 7,506,592 | B2 * | 3/2009 | Rossini | 108/50.01 |
| 7,859,836 | B2 * | 12/2010 | Bae | 108/50.02 |
| 2002/0073900 | A1 * | 6/2002 | Birsel et al. | 108/50.01 |
| 2003/0213415 | A1 * | 11/2003 | Ross et al. | 108/50.02 |
| 2004/0094072 | A1 * | 5/2004 | Fabian | 108/50.01 |
| 2004/0216647 | A1 * | 11/2004 | Cvek | 108/50.02 |
| 2004/0237852 | A1 * | 12/2004 | Tsai | 108/50.01 |

(Continued)

FOREIGN PATENT DOCUMENTS

| | | |
|---|---|---|
| JP | 62-142930 | 9/1987 |
| JP | 846114 | 8/1992 |

(Continued)

OTHER PUBLICATIONS

Notice of Reasons for Rejection issued in corresponding Japanese Patent Application No. 2010-270740 mailed Jun. 26, 2012, with translation.

*Primary Examiner* — Jose V Chen
(74) *Attorney, Agent, or Firm* — Banner & Witcoff, Ltd.

(57) ABSTRACT

A table is used in combination with another table having a circular top plate in a top view. The table comprises a top plate on a top surface of which an article can be placed and a support portion that supports the top plate from a lower surface side of the top plate. At least a part of a peripheral edge of the top plate is provided with a contact portion which is formed into a shape so as to contact a peripheral edge of the circular top plate of another table along a circumferential direction of the circular top plate.

10 Claims, 11 Drawing Sheets

U.S. PATENT DOCUMENTS

| | | | | |
|---|---|---|---|---|
| 2006/0117669 | A1 | 6/2006 | Baloga et al. | |
| 2007/0266913 | A1* | 11/2007 | Hardt | 108/147 |
| 2011/0197794 | A1* | 8/2011 | Nunes | 108/50.02 |

FOREIGN PATENT DOCUMENTS

| | | |
|---|---|---|
| JP | 06-026559 | 4/1994 |
| JP | 2001-154605 | 6/2001 |
| JP | 2003-024155 | 1/2003 |
| JP | 2008-522660 | 7/2008 |

* cited by examiner

TABLE AND TABLE SYSTEM

CROSS-REFERENCE TO RELATED APPLICATIONS

This application claims the benefit of Japanese Patent Application No. 2010-270740 filed Dec. 3, 2010 in the Japan Patent Office, the disclosure of which is incorporated herein by reference.

BACKGROUND

The present invention relates to a table which can be used alone as well as in combination with another table, and a table system.

Due to widespread use of information equipment, such as a personal computer, in an office, an information exchange using the information equipment is becoming popular, thereby lowering the frequency of an information exchange using printed material. Also, in a conference where a plurality of members gets together to share and review information concerning their work, information sharing or reviewing by displaying information on a display device have come into practice (for example, see Patent Document 1).

Meanwhile, a method for smoothly sharing and reviewing information in such a conference has been considered. The method includes changing the arrangement of a display device or the shape of a table depending on a form in which the information sharing or reviewing is performed (for example, see Patent Documents 2 and 3).

For example, Patent Document 2 discloses that when all participants in a conference share and review information, a plurality of tables are put together to constitute one large table, and when the participants are divided into a plurality of groups to share and review information, the one large table is divided into a plurality of tables each including a display device, and then sharing and reviewing of information is performed at each of the divided tables.

Patent Document 3 discloses a table system which can be used in a conference where a plurality of members participates as well as can be used for personal work by combining a circular core table, an oval-shaped side table, and a wagon on which a display device or the like can be placed.

PATENT DOCUMENT

Patent Document 1: Japanese Unexamined Patent Application Publication No. 2001-154605

Patent Document 2: Japanese Unexamined Patent Application Publication No. 2008-522660

Patent Document 3: Japanese Unexamined Patent Application Publication No. 2003-024155

When information is shared or reviewed by using a display device in a conference as described above, as long as the number of participants is adequate for a table on which a display device is placed, all participants are capable of viewing the information displayed on the display device without stress.

However, when the number of participants is large for the size of a table, the participants have to form a double or triple circle around the table. In this case, there has been a problem in that a participant near the table obstructs a view of a participant away from the table, thereby making it difficult for the participant away from the table to view the information displayed on the display device.

The present invention preferably may provide a table and a table system which facilitates responding to increase and decrease in the number of persons.

SUMMARY

A table according to the present invention is used in combination with another table having a circular top plate in a top view, and includes a top plate and a support portion. On a top surface of the top plate, an article (for example, a monitor, such as a display device, used with an electronic computer such as a personal computer, and an input portion such as a keyboard and a mouse) can be placed. The support portion supports the top plate from a lower side. A contact portion that contacts a peripheral edge of the circular top plate is formed along a peripheral edge of the plate-like shaped top plate. The contact portion is formed into a shape so as to contact the circular top plate along the circumferential direction thereof.

The top plate according to the present invention can be combined with the circular top plate in a stable manner, by contacting the contact portion of the top plate according to the present invention with the circular top plate of another table. Furthermore, even in a meeting involving the number of participants that is large enough to form a double or triple circle around another table, outside-located participants of the meeting can easily view the article placed on the top plate according to the present invention, by combining the table of the present invention with the another table and arranging the top plate according to the present invention so as to project from the circular top plate.

The contact portion is desirably formed into a shape so as to curve concavely toward a center of the top plate. Furthermore, the concave shape of the contact portion is desirably an arc shape having the substantially same radius of curvature as that of the circular top plate. Thus, the area in which the contact portion and the circular top plate contact each other can easily increase, thereby allowing the table according to the present invention to be combined with another table in a stable manner.

Preferably, the top plate is formed into a generally rectangular shape in a top view; a fixing portion for fixing an article that is a monitor such as a display device is provided near the first edge of the rectangular shape of the top surface of the top plate; and the contact portion is formed along at least one of the first edge and side edges adjacent to the first edge.

For example, when the contact portion formed along the first edge contacts the circular top plate, the fixing portion is arranged at the circular top plate side. Then, a region where the fixing portion is not provided on the top plate, i.e., a region where work can be conducted, is positioned at an opposite side (outside) to the circular top plate. Therefore, participants in a meeting can conduct their work facing the top plate according to the present invention from outside. Furthermore, when an article fixed to the fixing portion is a monitor such as a display device and the monitor is fixed so that a screen of the monitor faces outside, even the participants away from another table, among the participants in the meeting who surround the another table and the table according to the present invention, can easily view the contents displayed on the monitor.

On the other hand, when the contact portion formed along a side edge contacts the circular top plate, a substantially L-shaped work space is formed by another table and the table according to the present invention. In other words, the top plate according to the present invention is arranged to extend radially outward from another table. Therefore, the operator located between another table and the table according to the present invention can be offered wider work space compared to when only another table is used.

Preferably, the top plate is formed into a generally rectangular shape in a top view; a fixing portion for fixing an article that is a monitor such as a display device is provided near the first edge on the top surface of the top plate; a contact portion is formed at least side edges that are a pair of side edges adjacent to the first edge: and a distance between the pair of side edges decreases toward the first edge side.

When the contact portion formed at the side edges contacts the circular top plate, an angle at an intersection point of another table and the table according to the present invention is wider than 90 degree, and a substantially L-shaped work space narrower than 180 degree is formed. In other words, the top plate according to the present invention extends radially outward from another table, and is arranged such that the first edge at which the fixing portion is disposed is rotated in an approaching direction toward another table. Therefore, a distance, at which an operator moves his/her vision between a work space at another table and a work space at the table according to the present invention, can be shortened, compared to when an angle at the intersection point of another table and the table according to the present invention is 90 degree or 180 degree.

For example, when an article placed on the table is a monitor such as a display device, the table according to the present invention can be arranged so that an interior angle formed between a front face of the monitor placed on the table according to the present invention and a front face of the monitor placed on another table becomes an obtuse angle that is larger than 90 degree and smaller than 180 degree.

Preferably, an article placed on the top surface of the top plate is a monitor, and the support portion includes a housing portion which houses an electronic computer which outputs image signals to the monitor. Thus, an operator can perform work by using an electronic computer housed in the housing portion and the monitor. In other words, the table according to the present invention can be separated from another table and used alone to conduct work.

According to a table and a table system of the present invention, a contact portion that contacts a peripheral edge of a circular top plate is formed on a peripheral edge of the top plate formed into a plate-like shape. Since the contact portion is formed into a shape so as to contact the circular top plate along the circumferential direction thereof, even if the number of participants in the meeting is large enough to form a double or triple circle around the circular top plate, the outside participants can easily view the article placed on the top plate according to the present invention, by combining the top plate according to the present invention with the circular top plate and arranging the top plate according to the present invention so as to project from the circular top plate. Therefore, by using the table and the table system of the present invention, effect is obtained in that responding to increase and decrease in the number of operators is facilitated.

DETAILED DESCRIPTION OF THE PREFERRED EMBODIMENT

Figure 8:
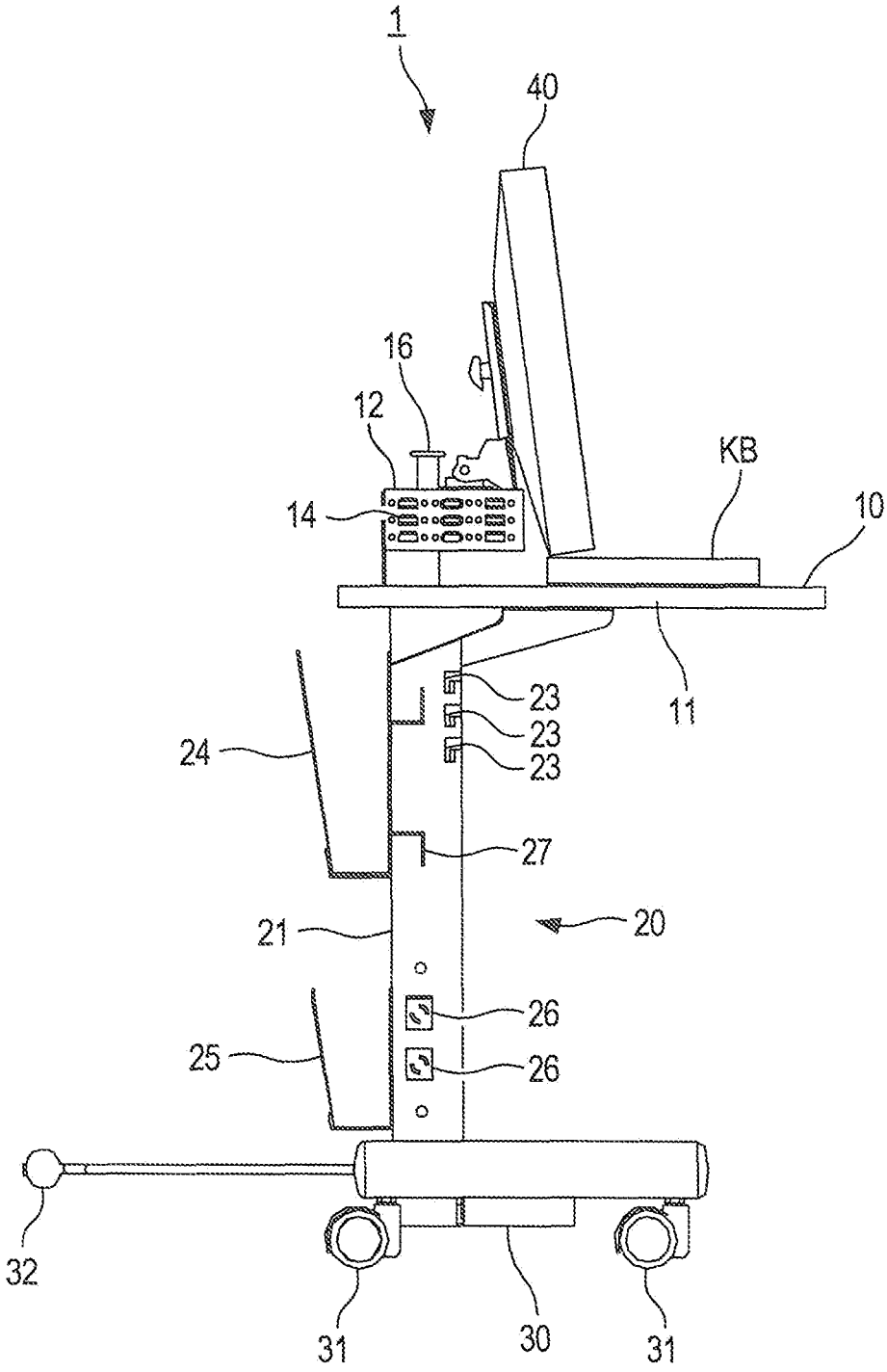
FIG. 8 is a side view of the auxiliary table in FIG. 5 seen from a right-side direction.
Figure 9:
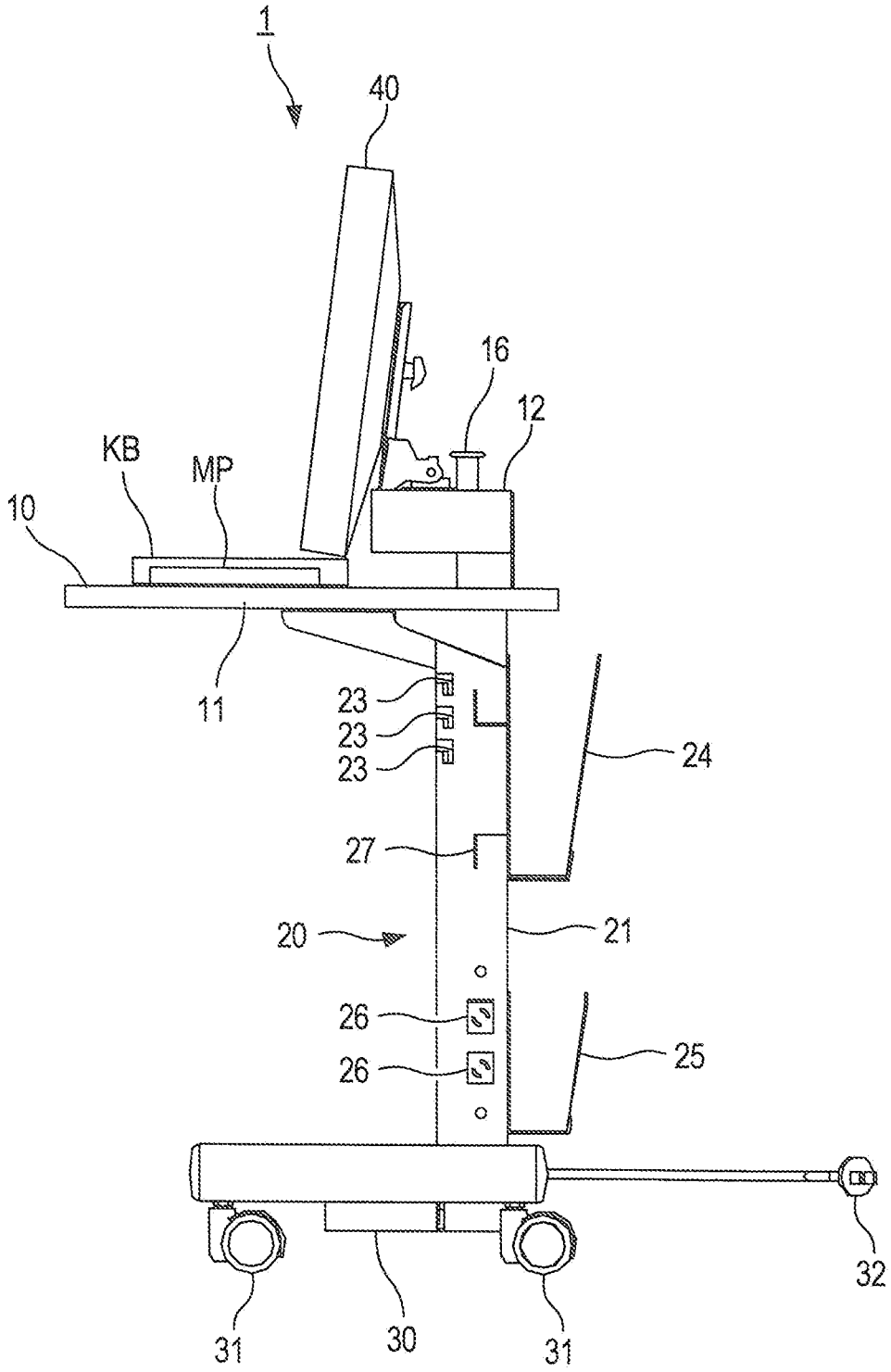
FIG. 9 is a side view of the auxiliary table in FIG. 5 seen from a left-side direction.
Figure 10:
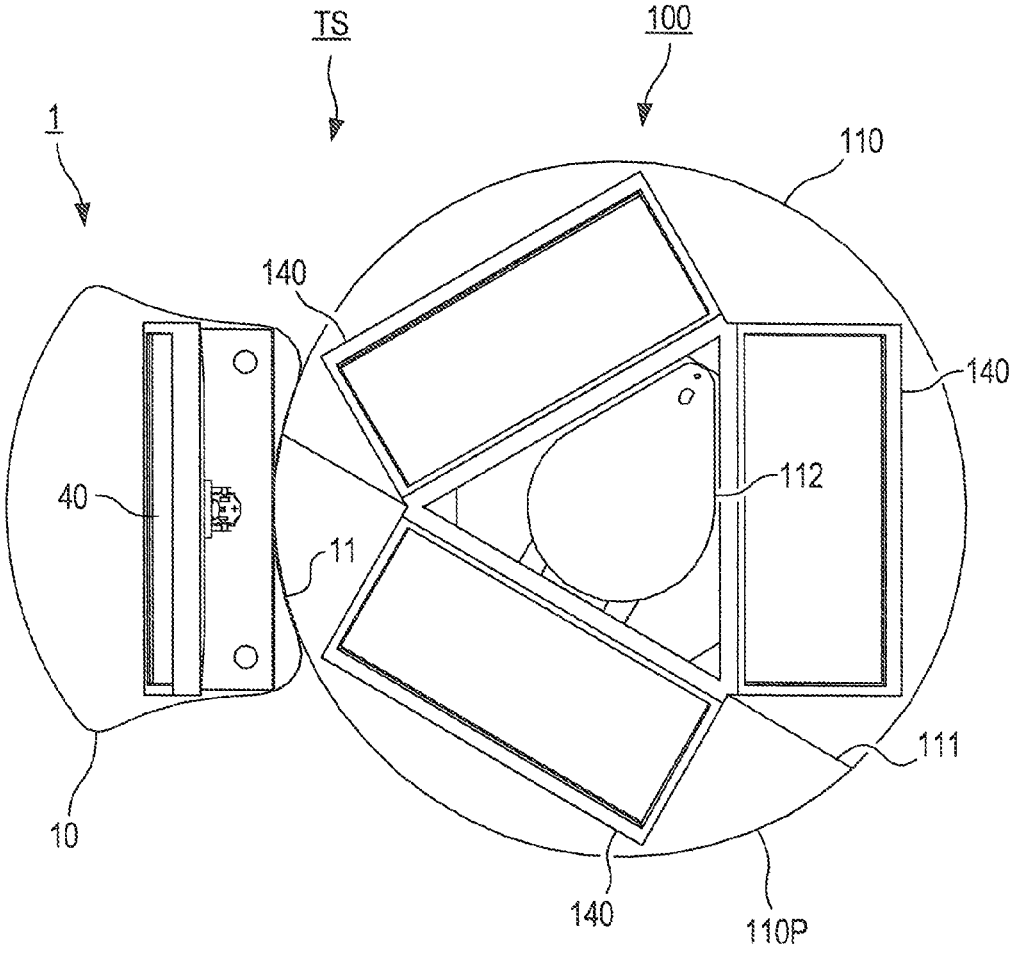
FIG. 10 is a top surface view, showing one exemplary combination in a table system including the auxiliary table in FIG. 1.
Figure 11:
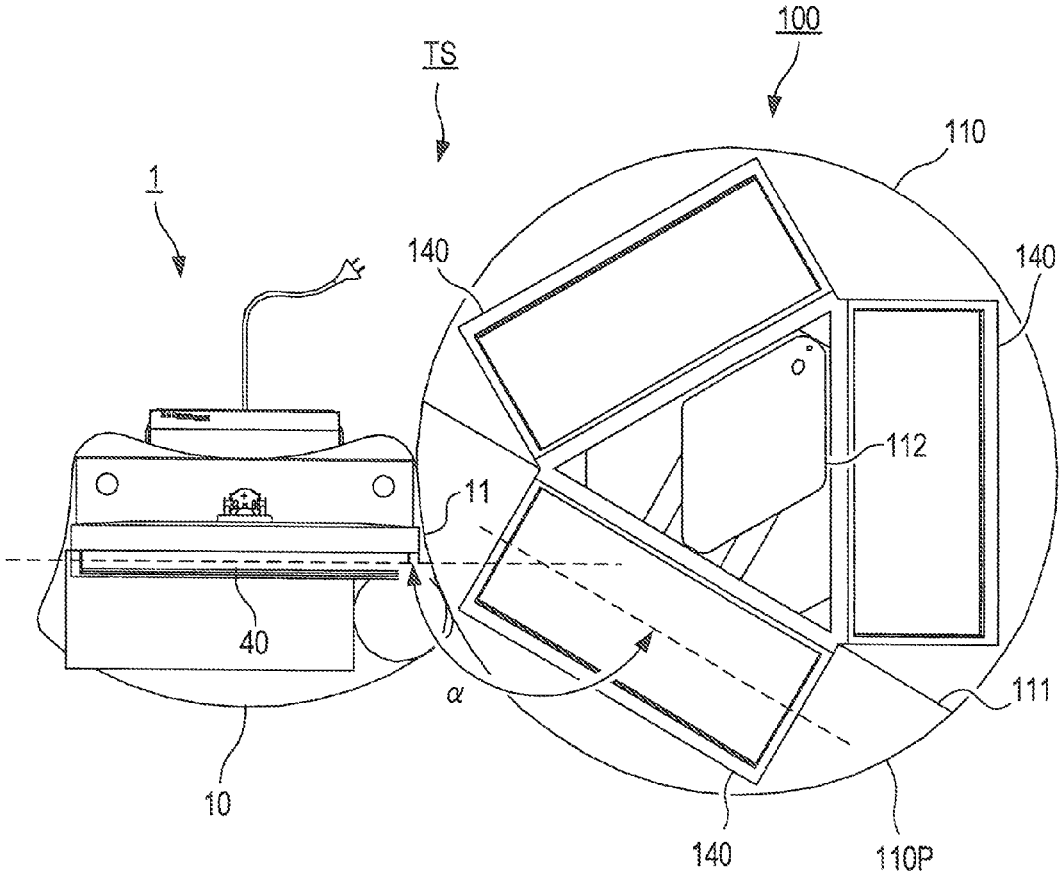
FIG. 11 is a top surface view showing another exemplary combination in the table system in FIG. 10.

As shown in FIGS. 10 and 11, the auxiliary table 1 according to the present embodiment is used in combination with a main table (another table) 100 described below to constitute a table system TS, as well as is used alone as shown in FIGS. 1 to 9. For example, the table system TS, that is a combination of the main table 100 and the auxiliary table 1, is used in a meeting involving a plurality of participants, and the auxiliary table 1 is used alone for personal work.

The auxiliary table 1 primarily includes, as shown in FIG. 1 through FIG. 9, a top plate 10, a column portion (support portion) 20 and a base portion (support portion) 30. On a top surface of the top plate 10, a keyboard KB, a mouse pad MP or a mouse (not shown) can be placed. The column portion 20 supports the top plate 10.

The top plate 10 is a member formed into a plate-like shape. The top surface of the top plate 10 is used as a work space. As shown in FIG. 4, the top plate 10 is formed into a generally rectangular shape, which is framed by a front edge 10*a*, a rear edge 10*b* (the first edge), a right edge 10*c* (a side edge) and a left edge 10*d* (a side edge). The top plate 10 further includes, as shown in FIG. 1 through FIG. 4, a contact portion 11 that contacts a circular top plate 110 of the main table 100 and a fixing portion 12 for fixing a monitor 40 that is a display device.

The front edge 10*a* of the top plate 10 is an arc-shaped portion curved toward the direction (downward in FIG. 4) away from a center of the top plate 10. A person who works with the auxiliary table 1 primarily sits on a chair at the front edge side of the top plate 10 facing the top plate 10.

Each of the rear edge 10*b*, the right edge 10*c* and the left edge 10*d* is a portion along which the contact portion 11 is formed, and is also an arc-shaped portion curved toward the center of the top plate 10. That is to say, the contact portion 11 formed along the rear edge 10*b* is formed into an arc shape curved toward the downward direction of FIG. 4; the contact portion 11 formed along the right edge 10*c* is formed into an arc shape curved toward the left direction of FIG. 4; and the contact portion 11 formed along the left edge 10*d* is formed into an arc shape curved toward the right direction of FIG. 4. An arc constituting the contact portion 11 has the substantially same radius of curvature as that of the circular top plate 110 of the main table 100 described below.

As shown in FIG. 4, the top plate 10 is configured so that a distance between a line RT and a line LT decreases as approaching from a front edge 10*a* toward the rear edge 10*b* (from a bottom to the top in FIG. 4). The line RT connects the front edge-side end and the rear edge-side end of the contact portion 11 along the right edge 10*c*. The line LT connects the front edge-side end and the rear edge-side end of the contact portion 11 along the left edge 10*d*.

Furthermore, the top plate 10 is configured so that the line RT and the line LT described above, a line RR connecting the right edge-side end and the left edge-side end of the contact portion 11 along the rear edge 10*b*, and a line FT connecting the right-side end and the left-side end along the front edge 10*a* forms a substantial trapezoid.

In the present embodiment, it has been described that each of the rear edge 10*b*, the right edge 10*c* and the left edge 10*d* is formed into an arc shape, and continuously contacts the circular top plate 110. However, the present invention is not limited to the configuration according to the present embodiment, and may be configured so as to, for example, be formed into a polygonal shape to contact the circular top plate 110 discretely (for example, at two locations), rather than to contact it continuously.

The fixing portion 12 is, as shown in FIG. 1 through FIG. 4, located in the vicinity of the rear edge 10*b* on the top surface of the top plate 10, and formed into a generally rectangular parallelepiped shape.

Figure 1:
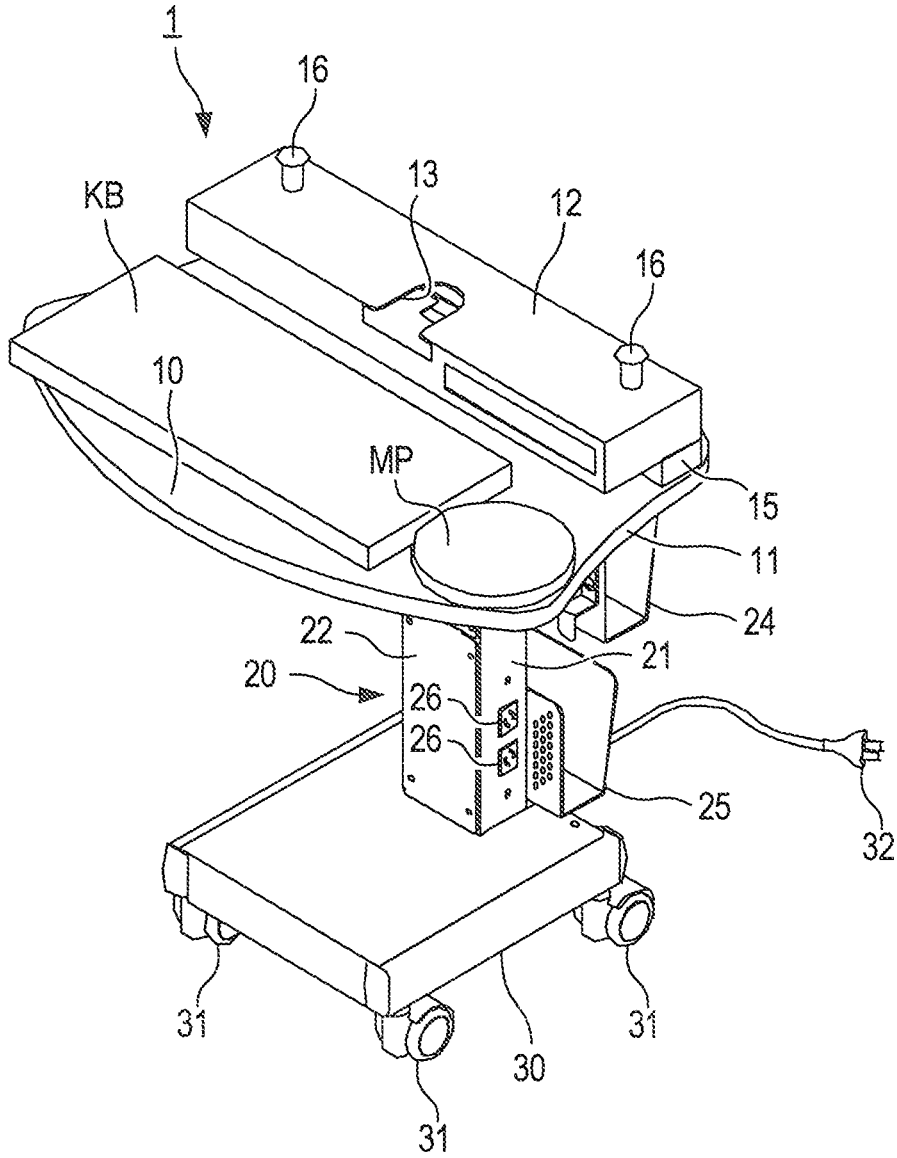
FIG. 1 is a perspective view seen from a diagonally upper front direction, showing a configuration of an auxiliary table according to one embodiment of the present invention.
Figure 2:
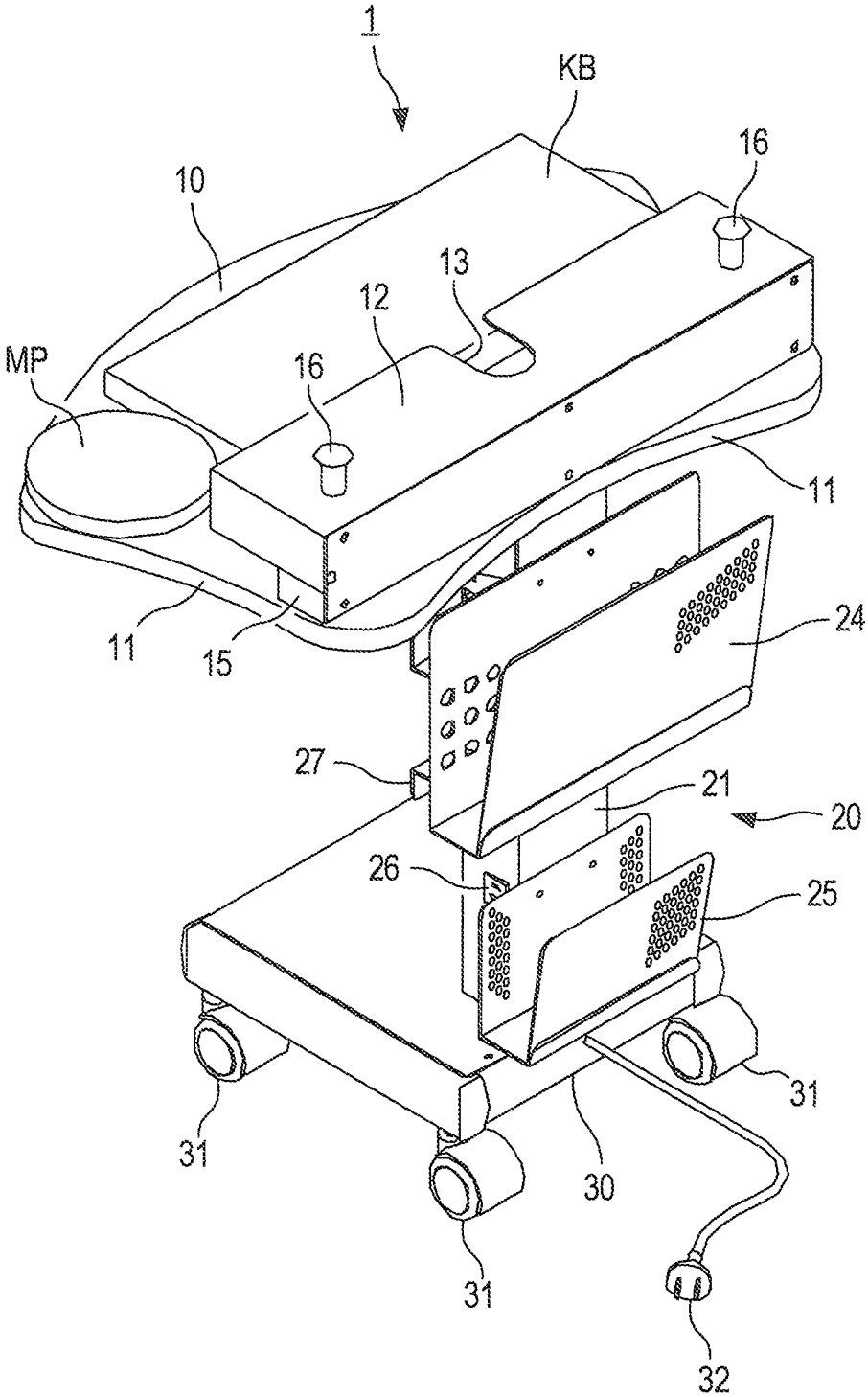
FIG. 2 is a perspective view of the auxiliary table in FIG. 1 seen from a diagonally upper rear direction.

A top surface of the fixing portion 12 is, as shown in FIG. 1, FIG. 2 and FIG. 4, provided with a mounting portion 13 used for mounting the monitor 40. The mounting portion 13 is dented from a front edge side toward the rear edge side on the top surface of the fixing portion 12 so as to form a notch shape.

Figure 3:
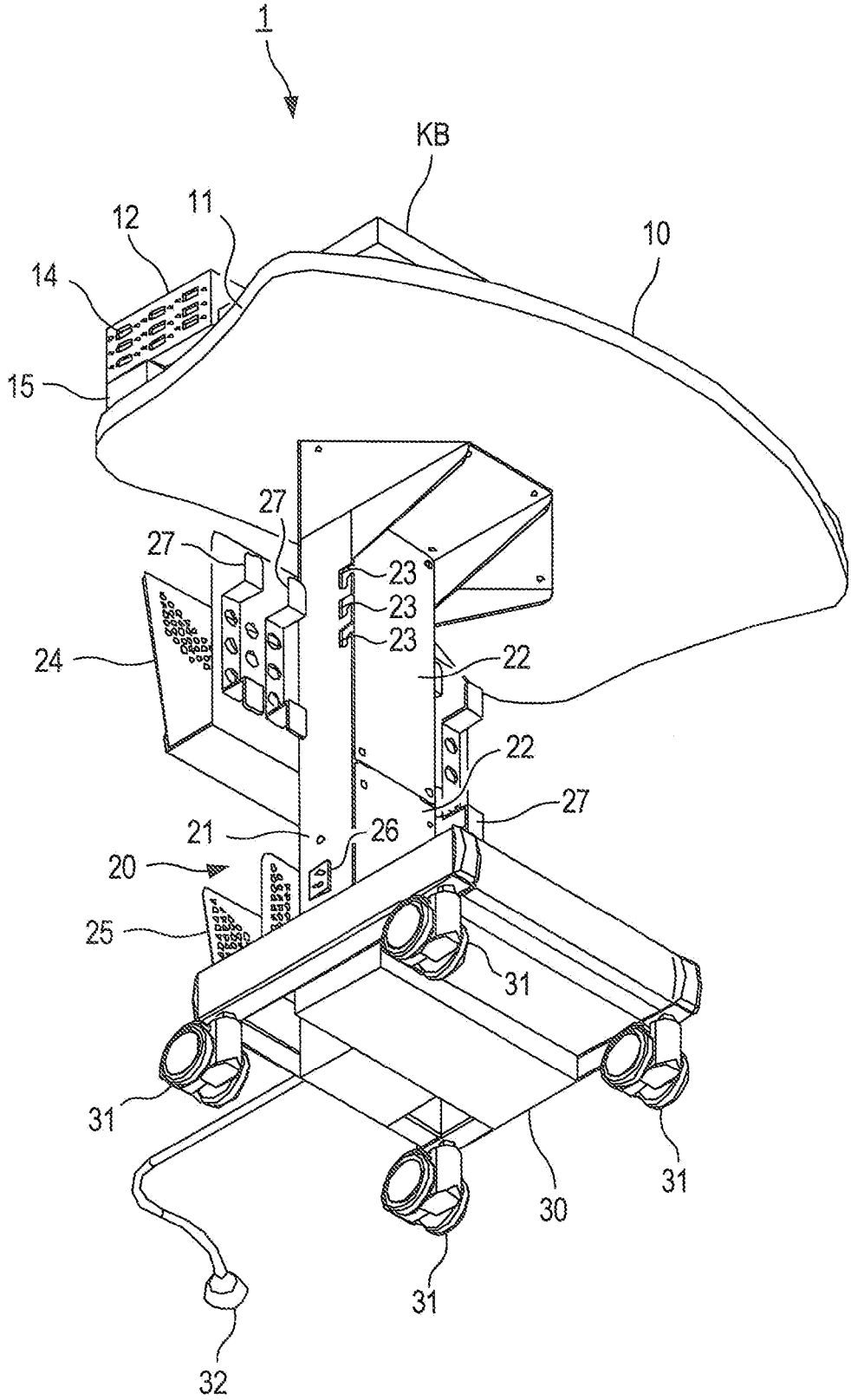
FIG. 3 is a perspective view of the auxiliary table in FIG. 1 seen from a diagonally lower front direction.
Figure 4:
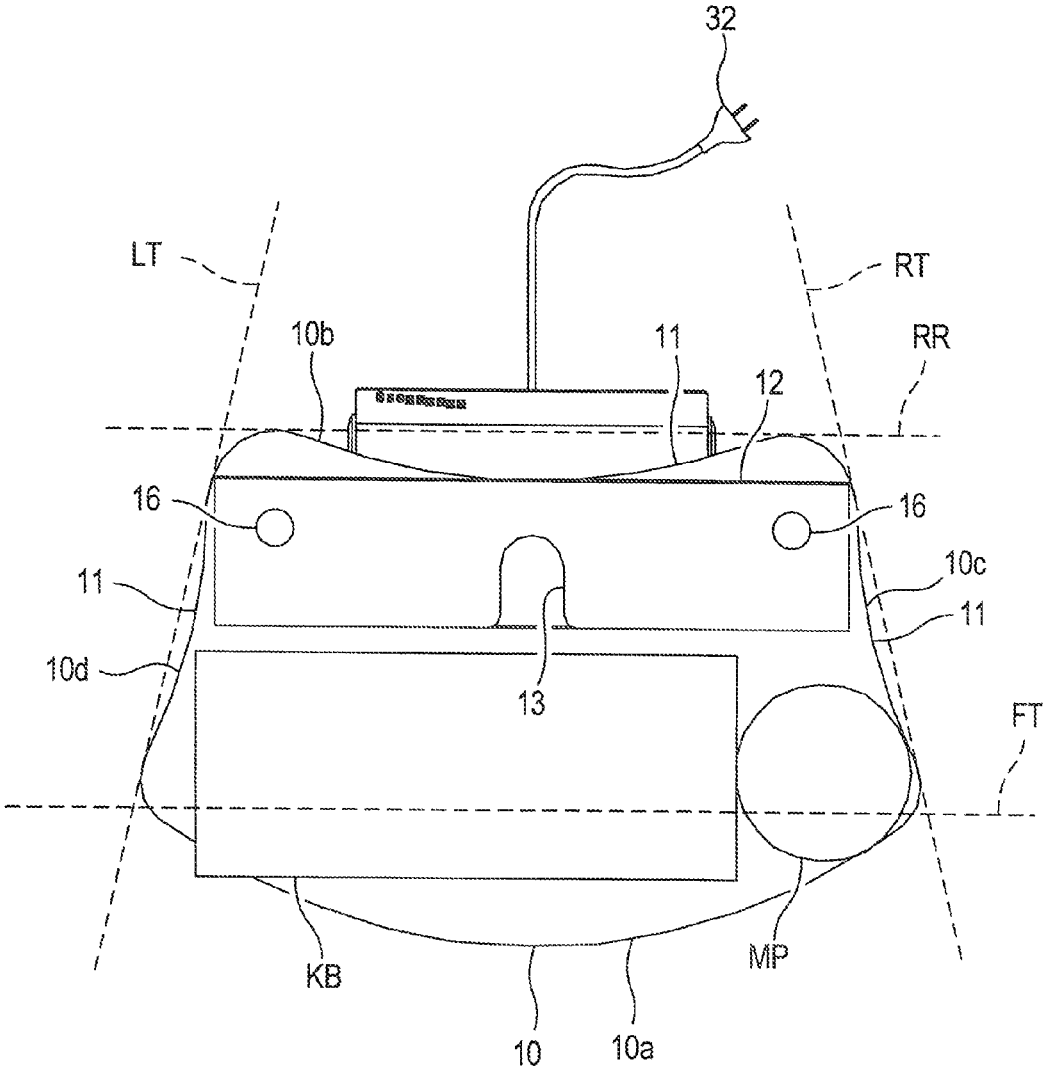
FIG. 4 is a top surface view, showing a configuration of the top plate in FIG. 1.

A plurality of connecting terminals 14 is provided on a left side of the fixing portion 12, as shown in FIG. 3 and FIG. 8. The plurality of connecting terminals 14 is primarily used when using the auxiliary table 1 in combination with the main table 100, and so that image signals for displaying an image on the monitor 40 is inputted from outside, for example, from an electronic computer housed in the main table 100. The standard of each of the plurality of connecting terminals 14 differs each other.

The bottom end of the rear side of the fixing portion 12 is, as shown in FIG. 1, FIG. 8 and FIG. 9, provided with a rectangular parallelepiped-shaped intervening portion 15. The intervening portion 15 is disposed all the way from a right edge to the left edge (from a diagonally right downward direction to the diagonally left upward direction in FIG. 1) of the top plate 10 between the top plate 10 and the fixing portion 12. By disposing the intervening portion 15, a dent having an opening toward the front edge 10*a* of the top plate 10 is formed between the top plate 10 and the fixing portion 12. The dent can house at least a part of the keyboard KB.

The top surface of the fixing portion 12 is, as shown in FIG. 1, FIG. 2 and FIG. 4, provided with a pair of upper cable holding portions 16. The upper cable holding portions 16 are wrapped with cables, and used when, for example, holding cables which are plugged into the above-described connecting terminals 14. The upper cable holding portions 16 are cylindrical members projecting upward from the top surface of the fixing portion 12, and disposed in the vicinity of the right edge end (right side in FIG. 4) and the left edge end (left side in FIG. 4) of the fixing portion 12 respectively.

The column portion 20 is, as shown in FIG. 6 through FIG. 9, formed into a generally rectangular tube. The upper end of the column portion 20 is attached to the rear edge side on the bottom surface of the top plate 10, and the lower end of the column portion 20 is attached to the top surface of a base portion 30. Various types of cables such as power cables can be housed inside the column portion 20 formed into a rectangular tube shape.

More specifically, the column portion 20 primarily includes a column body 21 formed into a substantial U-shape in a cross-sectional view and a lid 22 which closes an opening of the column body 21. The opening of the column body 21 is arranged so as to open toward the front edge 10*a* of the top plate 10. Also, the generally rectangular tube-like column portion 20 is constituted by closing the opening of the column body 21 with the lid 22. The lid 22 is removably attached to the column body 21 using a fastening member such as a screw.

The column body 21 is, as shown in FIG. 8 and FIG. 9, provided with lead-out portions 23 each used for leading out a cable disposed inside the column portion 20. Each of the lead-out portions 23 is a slit formed on a side wall of the column body 21, and formed so as to communicate with the opening of the column body 21. Each of the lead-out portions 23 horizontally extends from the opening of the column body 21 and then bends downward to form a substantial L-shape. The cable inserted through each of the lead-out portions 23 is disposed in a downwardly bending portion of the lead-out portion 23 by gravity.

Therefore, even when the lid 22 is removed from the column body 21 and the end of each of the lead-out portions 23 opens, the cable inserted through the lead-out portion 23 does not drop out of the end of the lead-out portion 23 against gravity. Furthermore, by forming each of the lead-out portions 23 into a substantial L-shape, the downwardly bending portion of the lead-out portion 23 is formed so as to extend substantially in parallel to the opening of the column body 21. Therefore, in a connecting portion between the lead-out portion 23 and the opening of the column body 21, the width between the downwardly bending portion of the lead-out portion 23 and the opening of the column body 21 can be secured, thereby facilitating securing the strength of a plate-like member constituting the column body 21.

Figure 7:
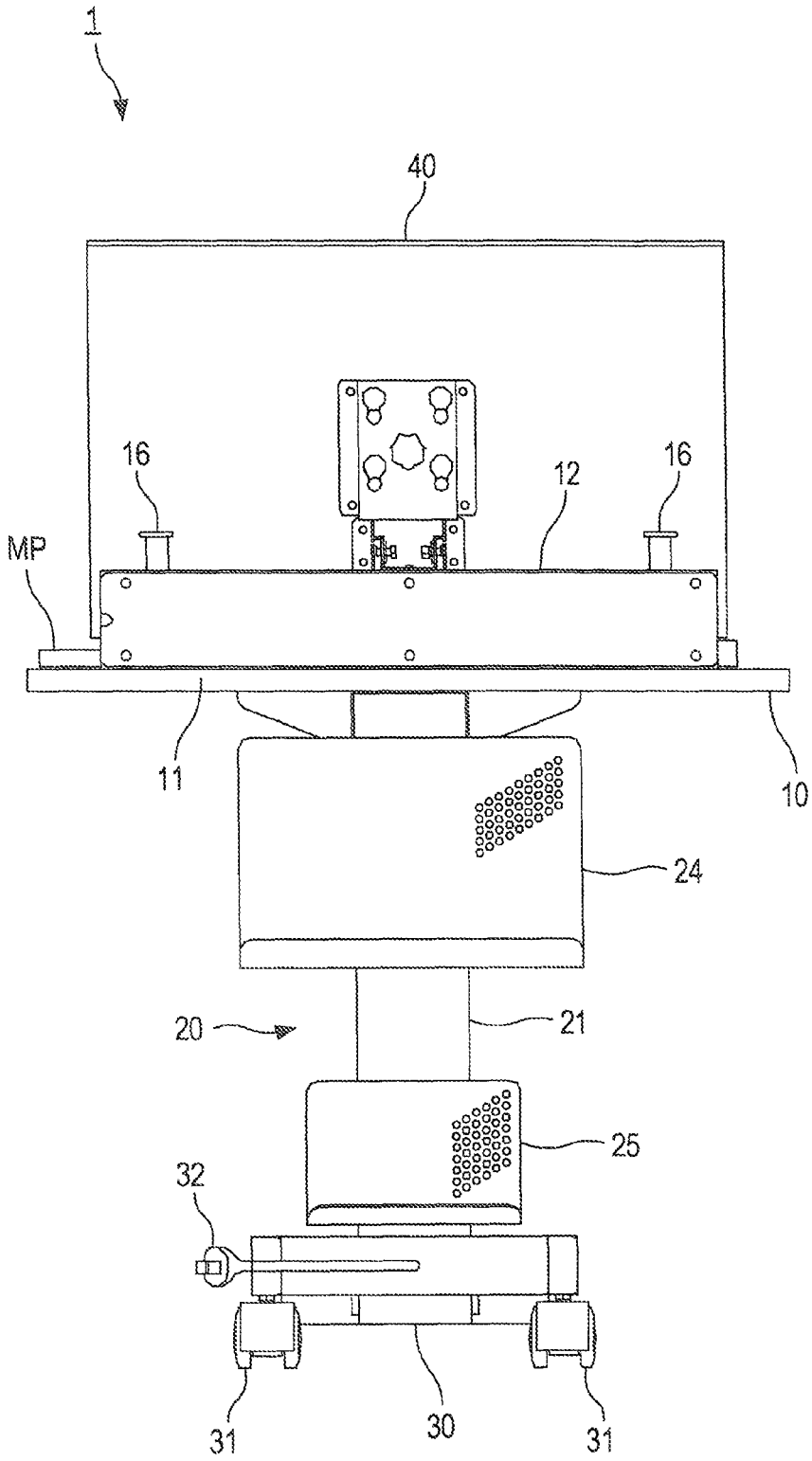
FIG. 7 is a view of the auxiliary table in FIG. 5 seen from a rear direction.

Furthermore, the column portion 20 is, as shown in FIG. 7 through FIG. 9, provided with an upper housing portion (housing portion) 24 which houses an electronic computer such as a personal computer, a lower housing portion 25 which houses a power supply unit such as a power plug and an AC-DC adaptor which is connected to an electronic computer, and electrical outlets 26 into which a power plug of an electronic computer or the like is inserted.

Each of the upper housing portion 24 and the lower housing portion 25 is a rack-like structure formed into a U-shape in a cross-sectional view, and is disposed on the surface at the rear edge side of the column portion 20 (left side in FIG. 8). A wall portion of each of the upper housing portion 24 and the lower housing portion 25 at a side away from the column portion 20 (left side in FIG. 8) is formed so as to slant upward in a direction away from the column portion 20. Therefore, the upper housing portion 24 and the lower housing portion 25 are formed so as to have a shape that opens upward, thereby facilitating housing an electronic computer or the like inside.

Figure 5:
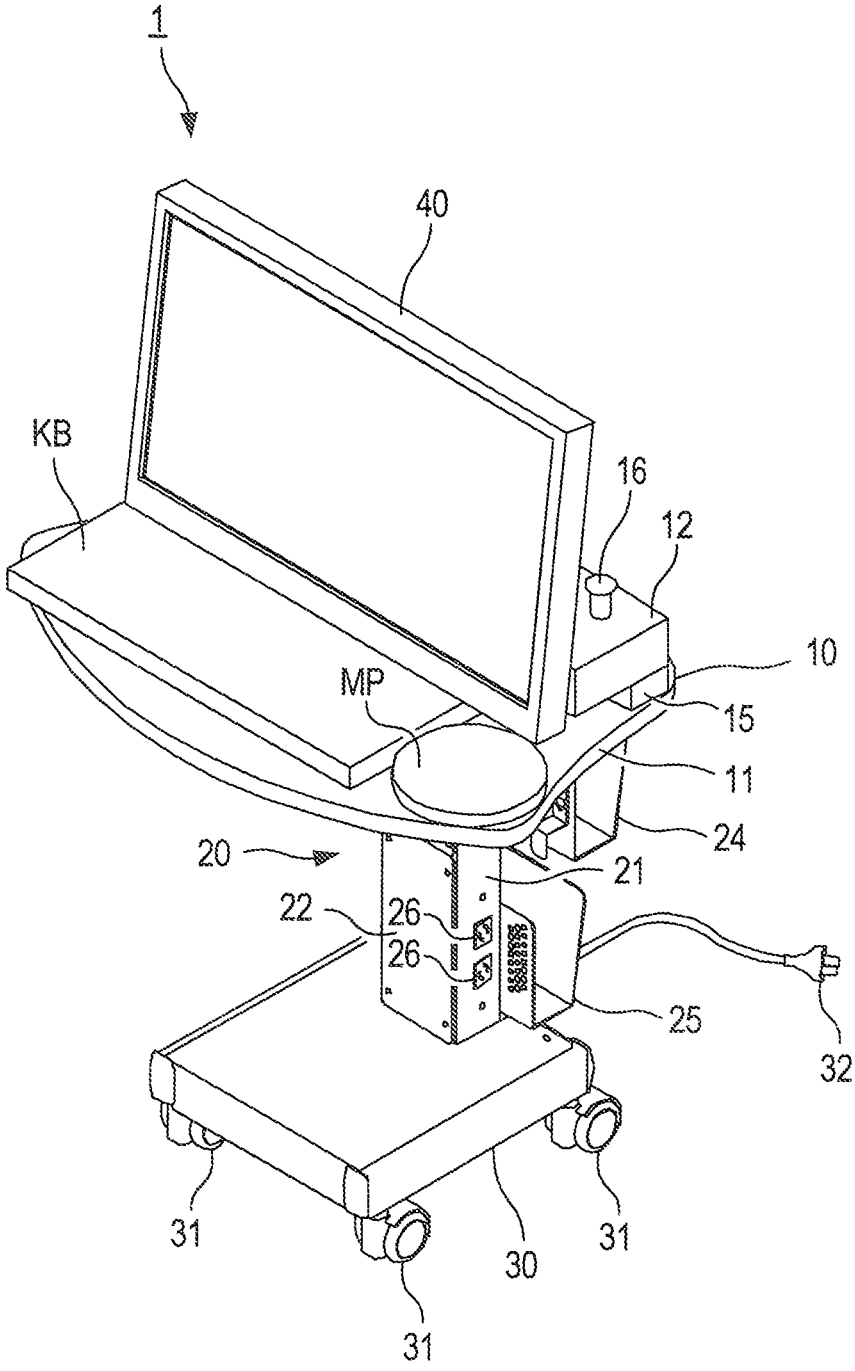
FIG. 5 is a perspective view seen from a diagonally upper front direction, showing that a monitor is attached to the auxiliary table in FIG. 1.

Also, as shown in FIG. 5, the upper housing portion 24 and the lower housing portion 25 are formed so as to open at the right edge side and the left edge side (the diagonally right downward side and the diagonally left upward side in FIG. 5) of the top plate 10 too. Thus, each of the upper housing portion 24 and the lower housing portion 25 can hold an article larger than the upper housing portion 24 or the lower housing portion 25 respectively, by allowing the larger article to protrude out of the openings at the left and right sides.

The upper housing portion 24 is disposed above the lower housing portion 25 and in the vicinity of the lead-out portions 23. A wall portion of the upper housing portion 24 at the column portion 20 side is provided with lower cable holding portions 27 around which cables are wrapped.

Figure 6:
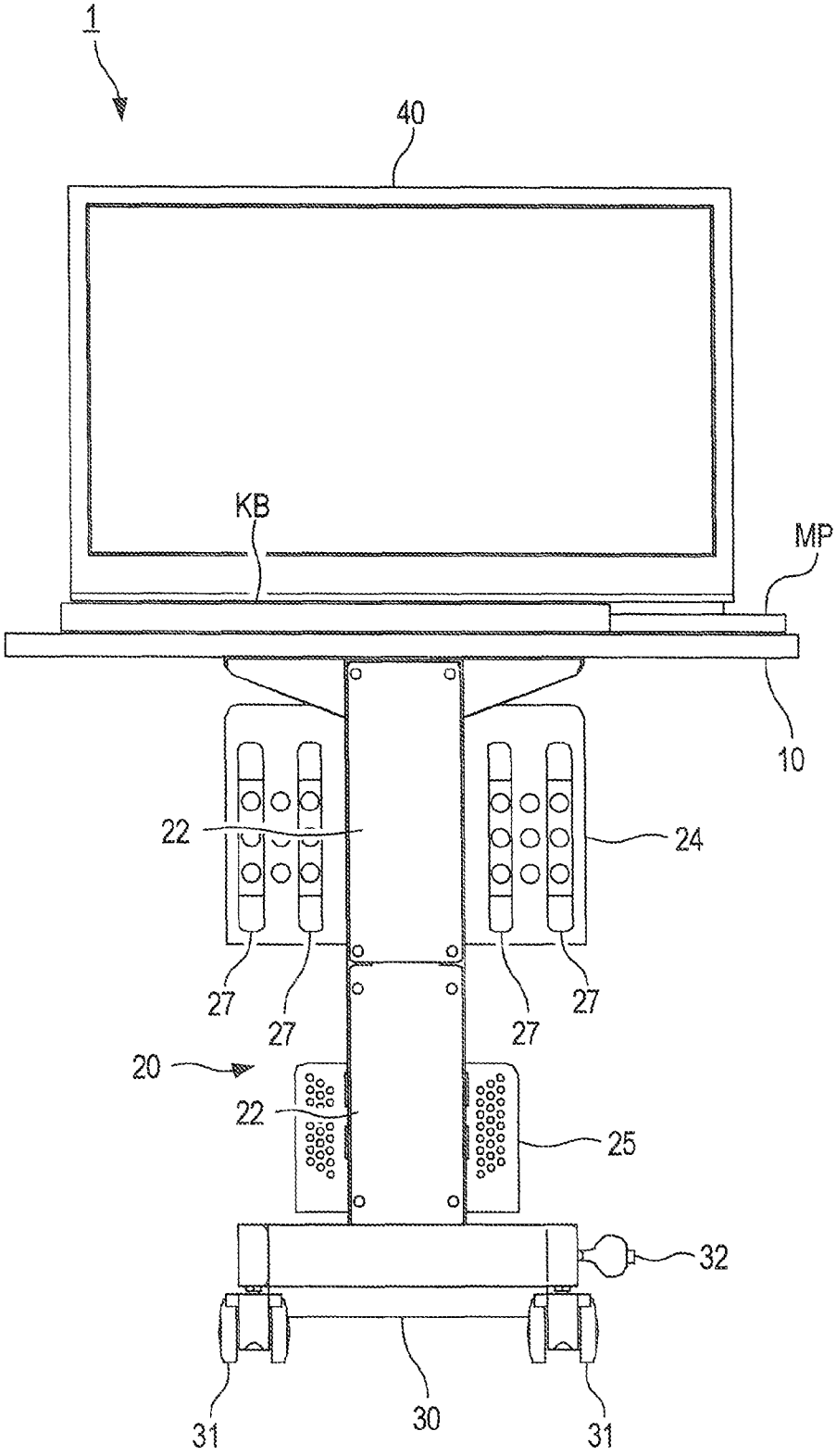
FIG. 6 is a view of the auxiliary table in FIG. 5 seen from a front direction.

Each of the lower cable holding portions 27 is, as shown in FIG. 8 and FIG. 9, formed of a pair of plate members projecting in an L-shape from the wall surface of the upper housing portion 24 in a side view. Four lower cable holding portions 27 are aligned in the horizontal direction, as shown in FIG. 6. For example, the cables or the like to be connected with an electronic computer housed in the upper housing portion 24 are wrapped around the lower cable holding portions 27.

The lower housing portion 25 is, as shown in FIG. 6 through FIG. 9, located below the upper housing portion 24 and in the vicinity of the electrical outlets 26. The lower housing portion 25 is formed so as to be smaller compared to the upper housing portion 24.

Each of the electrical outlets 26 is an outlet disposed in the lower portion of the column portion 20, and primarily supplies power to an electronic computer housed in the upper housing portion 24. In the present embodiment, an example, in which two electrical outlets are located in the lower portion of each of the side surfaces of the column portion 20 so that four electrical outlets in total are disposed, is applied and will be described below.

The base portion 30 is, as shown in FIG. 6 through FIG. 9, formed into a generally rectangular parallelepiped shape, and a top surface of the base portion 30 is attached to a bottom end of the column portion 20. The width in the horizontal direction (the horizontal direction in FIG. 6) of the base portion 30 is formed so as to be narrower than the horizontal width of the top plate 10. The length in the back-and-forth direction (in the horizontal direction in FIG. 8) is also formed so as to be shorter than the horizontal length of the top plate 10. Thus, a space around operator's feet when working with the auxiliary table 1 can be secured. Furthermore, when the auxiliary table 1 is combined with the main table 100, the base portion 30 and a leg of the main table 100 are inhibited from obstructing each other.

The top surface of the base portion 30 is a removable lid, and a space is formed inside the base portion 30. In the space, a power supply unit, such as an AC-DC adaptor, a weight for stabilizing a posture of the auxiliary table 1, and the like are housed.

The base portion 30 is provided with casters 31 used for moving the auxiliary table 1 and an attachment plug 32 which is plugged into an external electrical outlet (not shown). The casters 31 are disposed on four corners of the bottom surface of the base portion 30, and a wheel of each of the casters 31 is pivotal about the mounting portion with the base portion 30. The attachment plug 32 extends from the center of the rear end (the left end in FIG. 8) of the base portion 30, and is electrically connected with the electrical outlets 26 disposed in the column portion 20.

FIG. 10 is a top surface view illustrating one exemplary combination in the table system TS according to the present embodiment. FIG. 11 is a top surface view illustrating another exemplary combination.

The main table 100 is, as shown in FIG. 10 and FIG. 11, primarily provided with a top plate (circular top plate) 110 formed into a substantially circular shape, and a holding portion 112 which is disposed on the top surface of the top plate 110 and which holds monitors 140 such as display devices.

In the present embodiment, an example, in which the top plate 110 is provided with a folding line 111 and a portion 110P of the top plate 110 is capable of bending downward, is applied and will be described below. The holding portion 112 is located in a substantial center of the top surface of the top plate 110, and holds the monitors 40 each apart at every 120 degree with a display screen of each of the monitors 140 faced to an outward direction of the top plate 110. Furthermore, the holding portion 112 is provided with a plurality of output terminals (not shown) which output image information of the images to be displayed on the monitor 40 attached to the auxiliary table 1.

Also, the main table 100 is provided with a housing portion (not shown) that houses information processing equipment. Image signals outputted from the information processing equipment are capable of displaying images on the monitors 140 of the main table 100 as well as on the monitor 40 of the auxiliary table 1 connected to the information processing equipment via a cable.

Next, the method for using the auxiliary table 1 configured as described above and the method for using the table system TS will be described.

When the auxiliary table 1 according to the present embodiment is used alone, as shown in FIG. 5 through FIG. 9, the monitor 40 is fixed to the fixing portion 12; an electronic computer is housed in the upper housing portion 24; and a power supply unit and a power plug (not shown) of the electronic computer housed in the upper housing portion 24 is housed in the lower housing portion 25. Then, the monitor 40 and the electronic computer housed in the upper housing portion 24 are connected each other via a cable for transmitting image signals, and the power plug of the electronic computer are connected with one of the electrical outlet 26.

An operator conducts work by operating an electronic computer with a keyboard KB placed on the top plate 10 and a mouse (not shown) placed on the mouse pad MP. Furthermore, an operator can conduct work on a space on the top plate 10 which is formed by pushing the keyboard KB into a gap between the fixing portion 12 and the top plate 10.

Next, the method for using the table system TS will be described with reference to FIG. 10 and FIG. 11. Firstly, as shown in FIG. 10, the table system TS, in which the contact portion 11 formed at the rear edge 10*b* of the top plate 10 is attached to the top plate 110 of the main table 100, will be described. In this case, the monitor 40 of the auxiliary table 1 is arranged so as to face the opposite direction to the main table 100, that is, a radially outward direction.

When the number of participants is too large for the main table 100, for example, the participants are forced to make a double or triple circle around the main table 100. This causes the visions of the outside participants toward the monitor 140 of the main table 100 to be blocked by the inside participants, thereby making it difficult for the outside participants to see the images displayed on the monitor 140.

On the other hand, the monitor 40 of the auxiliary table 1 combined with the main table 100 is located in a projecting position toward the radially outward direction, compared to the monitor 140 of the main table 100. In other words, the distance between the outside participants and the monitor 40 of the auxiliary table 1 is shorter than that between the outside participants and the monitor 140 of the main table 100. As a result, the visions of the outside participants toward the monitor 40 of the auxiliary table 1 are less blocked by the inside participants, thereby facilitating the outside participants seeing an image displayed on the monitor 40.

Next, as shown in FIG. 11, the table system TS, in which the contact portion 11 formed at the right edge 10*c* of the top plate 10 is attached to the top plate 110 of the main table 100, will be described. In this case, an angle $\alpha$ of the monitor 40 of the auxiliary table 1 to the monitor 140 of the main table 100 is larger than 90 degree and smaller than 180 degree. In the present embodiment, an example, in which the angle α is approximately 150 degree, is applied and will be described below.

In this case, one operator can conduct work by using the monitor 40 of the auxiliary table 1 and the monitor 140 of the main table 100 at the same time. While conducting work, if the front face of the monitor 40 and the front face of the monitor 140 are arranged so as to form approximately 90 degree therebetween, the operator has a difficulty of seeing the monitor 40 and the monitor 140 at the same time, and the operator cannot change his/her view from the monitor 40 to the monitor 140 and vice versa by turning his/her neck around. When the front face of the monitor 40 and the front face of the monitor 140 are arranged so as to form approximately 180 degree therebetween, that is to say, aligned in a straight line, the distances between the operator and the monitor 40 and between the operator and the monitor 140 become too long, thereby making it difficult for the operator to visually recognize the contents displayed on each of the monitor 40 and the monitor 140.

In contrast, by arranging the monitor 40 and the monitor 140 so as to form the predetermined obtuse angle α as in the present embodiment, an operator can easily view the monitor 40 and the monitor 140, and the distances from an operator to the monitor 40 and to the monitor 140 can be shortened. Therefore, the operator can visually recognize the contents displayed on each of the monitor 40 and the monitor 140 without difficulty.

In addition, compared to when working only with the main table 100 or only with the auxiliary table 1, an space on the top plate 110 of the main table 100 or on the top plate 10 of the auxiliary table 1 can be used for conducting work, thereby widening the work space to facilitate conducting work.

What is claimed is:

1. A table used in combination with another table having a circular top plate in a top view, the table comprising:

a top plate on a top surface of which an article can be placed; and a support portion that supports the top plate from a lower surface side of the top plate, wherein at least a part of a peripheral edge of the top plate is provided with a contact portion which is formed into a shape so as to contact a peripheral edge of the circular top plate of another table along a circumferential direction of the circular top plate, wherein the top plate is formed into a generally trapezoid shape in a top view, wherein a fixing portion for fixing the article is disposed in a vicinity of a first edge of the generally trapezoid shape on the top surface of the top plate, and wherein the contact portion is formed by concavely curving the first edge and at least one of side edges adjacent to the first edge toward a center of the top plate.

2. The table according to claim 1, wherein the contact portion is formed so as to concavely curve toward a center of the top plate.

3. The table according to claim 1, wherein the top plate is formed into a generally rectangular shape in a top view, wherein a fixing portion for fixing the article is disposed in the vicinity of a first edge on the top surface of the top plate, side edges that are a pair of edges adjacent to the first edge are arranged so that a distance between the pair of edges decreases toward a side of the first edge, and the contact portion is formed by concavely curving at least the side edges toward the center of the top plate.

4. The table according to claim 1, wherein the article is a monitor, and the support portion is provided with a housing portion which houses an electronic computer connected so as to be capable of outputting image signals to the monitor.

5. A table system comprising:

a main table provided with a circular top plate on a top surface of which an article is placed; and an auxiliary table on a top surface of which an article is placed, the auxiliary table being provided with a top plate, wherein a contact portion is disposed along at least a part of a peripheral edge of the auxiliary table, and the contact portion is formed into a shape so as to contact a peripheral edge of the circular top plate along a circumferential direction of the circular top plate, wherein the top plate of the auxiliary table is formed into a generally trapezoid shape in a top view, wherein a fixing portion for fixing the article is disposed in a vicinit of a first edge of the generally trapezoid shape on the top surface of the top plate of the auxiliary table, and wherein the contact portion is formed by concavely curving the first edge and at least one of side edges adjacent to the first edge toward a center of the top plate of the auxiliary table.

6. The table according to claim 1, wherein a curve of the contact portion has the same curvature as a curve of the another table.

7. The table according to claim 1, further comprising at least one cable holding portion for wrapping cables therearound in a fixing portion for fixing the article of the top plate.

8. The table according to claim 1, further comprising in the support portion at least one L-shaped slit for leading out a cable.

9. The table according to claim 1, wherein both of the side edges adjacent to the first edge are formed to be convavely curved toward the center of the top plate, and the first edge and both of the side edges have a same curvature as the peripheral edge of the circular top plate of the another table.

10. The table according to claim 1, wherein both of the side edges adjacent to the first edge are formed to be convavely curved toward the center of the top plate of the auxiliary table, and the first edge and both of the side edges have a same curvature as the peripheral edge of the circular top plate of the another table.

* * * * *